United States Patent [19]

Haughawout

[11] 4,070,569

[45] Jan. 24, 1978

[54] COLLAPSIBLE AND PORTABLE RIBBON LOUVER ATTACHMENT FOR LIGHTS TO LIMIT THE LATERAL DISTRIBUTION OF LIGHT

[76] Inventor: Edgar G. Haughawout, 10613 Sherwood Drive SW., Tacoma, Wash. 98498

[21] Appl. No.: 732,923

[22] Filed: Oct. 15, 1976

[51] Int. Cl.[2] ..... F21V 11/02

[52] U.S. Cl. ..... 362/352; 362/343; 362/354

[58] Field of Search ..... 240/46.01, 46.03, 46.07, 240/46.09, 46.31, 46.35, 46.27, 46.17, 46.19, 46.55, 1.3

[56] References Cited

U.S. PATENT DOCUMENTS

| | | | |
|---|---|---|---|
| 1,448,025 | 3/1923 | Bruecker | 240/46.31 |
| 1,498,484 | 6/1924 | Scherer | 240/46.07 X |

*Primary Examiner*—John Gonzales
*Attorney, Agent, or Firm*—David H. Deits; Roy E. Mattern, Jr.; Kenneth S. Kessler

[57] ABSTRACT

A louver attachment for lights is constructed so that it is collapsible and portable to permit its use in a variety of applications wherein it is placed over the front of a light source to limit lateral distribution of the light. This configuration is advantageously used in connection with photographer's lighting systems. A framework is provided having two oppositely positioned parallel horizontal members having a series of openings along their lengths. A pair of parallel vertical side members connect corresponding ends of horizontal members together. The interconnections are allowed to pivot so that the parallelogram shaped structure may be collapsed. A wide ribbon is then woven between the horizontal members passing through the openings to form louvers. The ribbon is secured at either end to the framework. Conventional methods of attachment serve to attach the louver attachment over the front of a light source. One form of the louver attachment consists of a pair of rigid ladder-like horizontal members connected together by a pair of rigid, vertical side members. The ribbon is woven between the rungs of the ladder-like members having their respective rungs so spaced as to form parallel and equally spaced louvers.

7 Claims, 6 Drawing Figures

COLLAPSIBLE AND PORTABLE RIBBON LOUVER ATTACHMENT FOR LIGHTS TO LIMIT THE LATERAL DISTRIBUTION OF LIGHT

BACKGROUND OF THE INVENTION

Louver assemblies for lights are generally used to direct or limit the distribution of the light emitted. U.S. Pat. Nos. 2,065,814 (Lennon) and 2,906,864 (Boutelle) illustrate two such louvers. The louvers are typically placed over the front of a reflector, such as a parabolic reflector, which is used to direct light from a light source and which partially encloses the source. The louver assemblies generally consist of a series of rigid planar slats secured to form a parallel grid.

Louvers are particularly useful in photographic work such as studio photography where artificial light is used to create desired combinations of shading and illumination on the subject matter. The ability to control the dispersion of light through the use of louvers is most helpful in achieving the desired effects. Further, in connection with frontal projection photography of the type described in Jenkins U.S. Pat. No. 2,727,427 wherein a background is projected on a reflex reflector screen which reflects light back only in the direction from which it came, control of the lateral dispersion of the illumination is particularly important. By limiting the light that is directed onto the subject in the foreground to that coming directly from light sources on the sides, the background which is projected from and reflected to the viewing camera's position does not become obliterated by the side illumination.

Since photographic lighting is often moved not only within the studio but to different locations it is desirable that a louver attachment can be removed from the light and collapsed to a small configuration for transportation and storage. It is also desirable that the louver design lend itself to lightweight, durable, and economical construction. It is further desired that the louver attachment be adaptable to fit a variety of configurations of light and reflector arrangements. Such a louver attachment is provided.

SUMMARY OF THE INVENTION

Louver attachments for lights are used to limit the dispersion of the light. They are typically made to attach across the front of a light and its associated reflector.

The louver attachment, herein provided, has a pair of parallel elongated members which have openings along their lengths. These members are connected to each other by a pair of elongated connecting links pivotally attached to corresponding ends of the elongated members. A ribbon is then attached to this framework created by the connecting links and elongated members. The ribbon is woven between the elongated members passing through the openings in them so that sections of the strand of ribbon form individual louvers. The attachment of the ribbon to the framework is accomplished preferably by simply securing the ends of the ribbon to a framework member.

The resulting louver attachment may be secured over the front of a light for use, such as with electronic flash units used in studio photography. The pivotal attachment of the framework permits the assembly to be collapsed by bringing a pair of opposite corners together. The thinness of the louver elements, the ribbon, permits the collapsed louver attachment to assume a small flat elongated package for storage or transportation.

In a preferred configuration, the elongated members are each formed from a pair of elongated, rigid, parallel bars with a series of parallel rods between them to form members which are ladder-like in appearance. The rods individually have a round cross-section. The connecting links which pivotally connect to the corresponding ends of the ladder-like members are each formed by a pair of elongated, rigid, parallel bars which connect between corresponding sides of the interconnected ends of the ladder-like structure. When constructed of a lightweight metal such as aluminum the framework is light and yet strong. The ribbon is, preferably, of a black fabric and relatively wide, for example 2¼ inches. The rods are so spaced that when the ribbon is woven between the ladder-like members, passing through the opening between rods, the resulting louver elements are substantially parallel and equally spaced. The ribbon at either end is wrapped around the last rod it contacts and fastened to itself for securement to the framework.

The preferred form of attachment of the louver attachment to a light is to provide three short channels attached to the center of three of the framework members. The openings of the channel are directed centrally so that the louver attachment will slide over the face of either a rectangular or round light reflector. The channels engage over a rim or similar protrusion on the light reflector to secure it in position.

DETAILED DESCRIPTION OF THE INVENTION

Introduction

Figure 1:
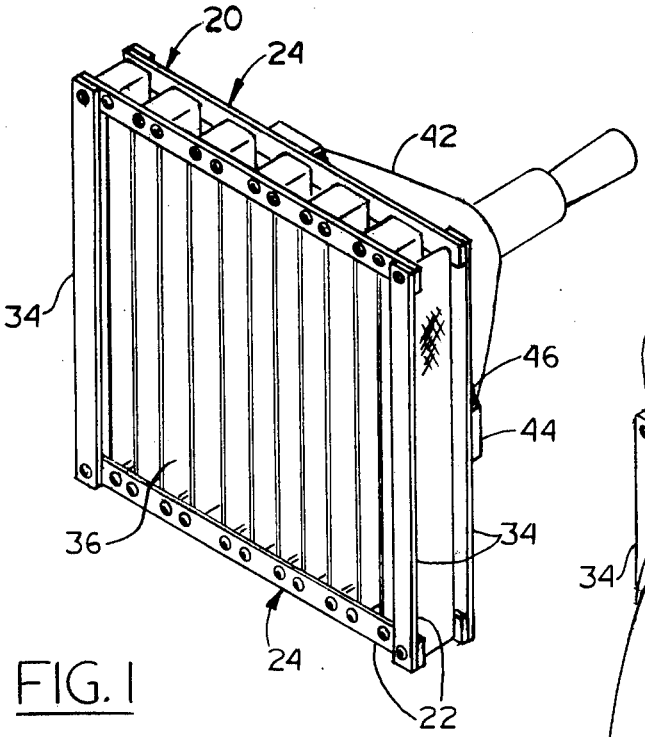
FIG. 1 is a perspective view of the preferred embodiment of the ribbon louver attachment on a typical flood light reflector.
Figure 2:
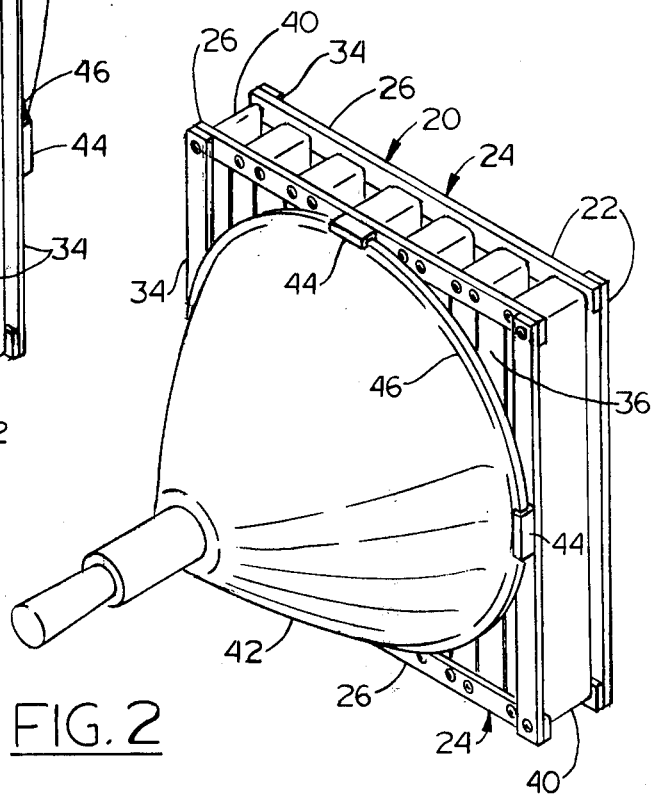
FIG. 2 is another perspective view of the preferred embodiment shown in FIG. 1 on a typical flood light reflector illustrating a method of attachment.

Louver assemblies for lights are generally used to control the distribution of light. They are particularly useful in photographic work where the control of the direction and intensity of illumination is very important. A louver attachment for lights which is described below provides the conventional functions of louvers and is additionally collapsible to a small package for storage and transportation. It is also suitable for light weight and relatively inexpensive construction while having a good appearance. It is adaptable for use in connection with a variety of lights such as those having either round, square, or rectangular reflectors as well as umbrella reflectors used commonly in studio photography.

Preferred Embodiment

Referring to FIGS. 1 through 5, the ribbon louver attachment 20 consists of a framework 22, in part, formed by a pair of elongated members having a series of openings along their length, preferably a ladder-like structure 24 having side members 26. The "rungs" of the ladder-like structure are formed by transverse members, preferably in the form of parallel rods 28 having round transverse cross-sections and smooth surfaces. The rods are fastened to the sidemembers 26. One preferred form of fastener which is used for attachment of the rods 28, which are preferably hollow, is pop rivets 30 which are inserted through holes 32 in the side members 26 into the open ends of the rods 28. The other framework component consists of elongated connecting links, such as the parallel bars 34 which are pivotally connected between corresponding ends of the two ladder-like structures 24 to hold them in a parallel and normally spaced relationship. The parallel relationship of the one or more bars 34 on one end of the ladder-like structures to those on the other end permits the framework to assume the form of a parallelogram and consequently the collapsed configuration illustrated in FIG. 4. The louvers 36 are preferably formed of a single ribbon 38 of light absorbing black fabric which is woven between openings in the two ladder-like structures 24. The rods 28 are preferably spaced so that the adjacent sections of louver are substantially parallel to each other and equally spaced. The ribbon ends 40 are preferably wrapped about the last rod they contact and sewn or otherwise fastened to themselves to secure the ribbon 38 to the framework.

Figure 3:
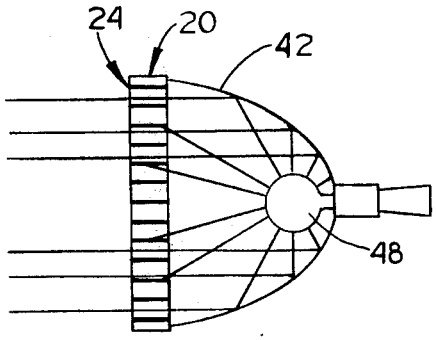
FIG. 3 is a top plan view in section of the ribbon louver attachment illustrating the effect of the louver attachment on the light from a typical flood light and reflector.

When the louver attachment 20 is secured across the front of a light reflector 42, such as by the use of three fixed, inwardly directed, channel sections 44 which slide over the reflector rim 46, the light from the light source 48 is controlled to reduce or limit the dispersion of light in a direction normal to the plane of the louvers, as shown in FIG. 3.

Figure 6:
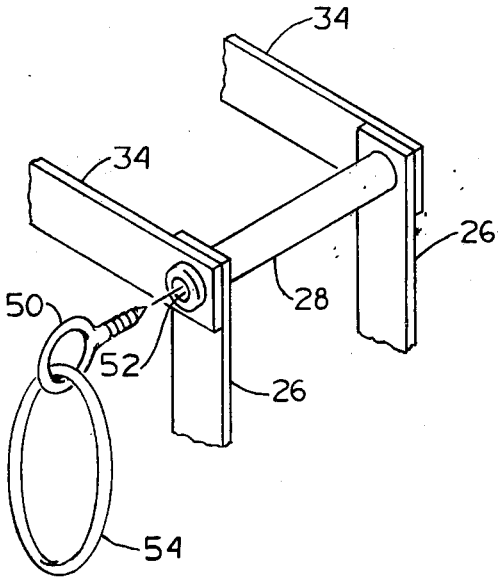
FIG. 6 is a perspective detail view of a corner of an embodiment of the ribbon louver attachment illustrating a connection device for securing the louver attachment to light reflector.

An alternate form of attachment to the lights is shown in FIG. 6. Screw eyes 50 are inserted in holes 52 in the end of some or all of the corner rods 28. Elastic bands 54 through the respective eyes are then used to secure the louver attachment 20 to hooks or appendages on a light reflector such as the ribs of an umbrella light reflector.

Figure 4:
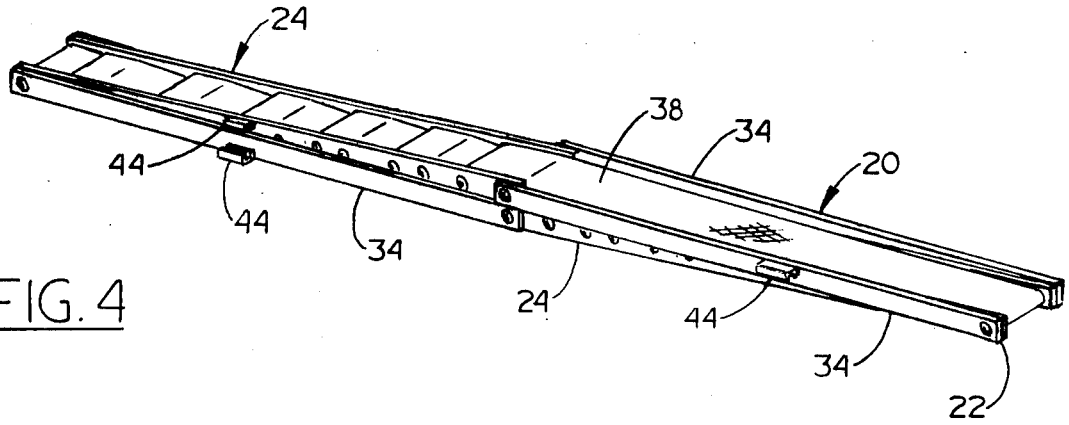
FIG. 4 is a perspective view of the preferred embodiment of the ribbon louver attachment in its collapsed position.
Figure 5:
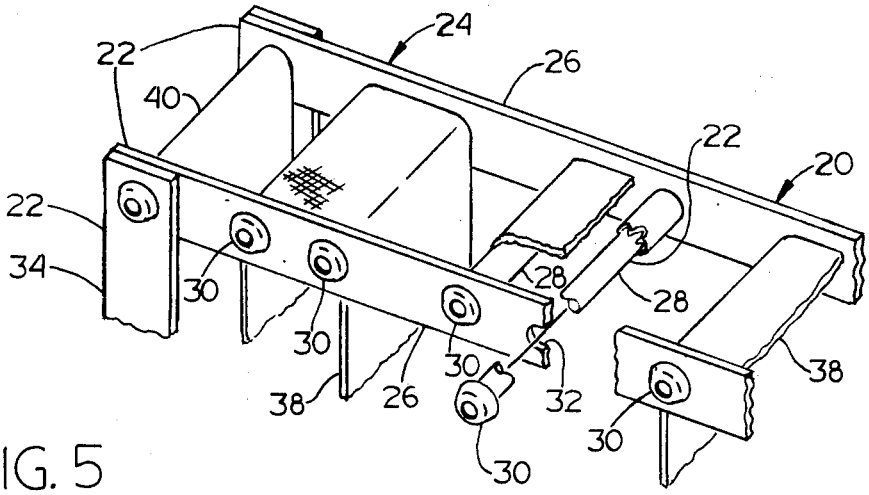
FIG. 5 is a perspective detail view of the preferred embodiment of the ribbon louver attachment.

The configuration of louver attachment is easily collapsed to a small, portable package, as shown in FIG. 4 with the ribbon 38 attached. When the attachment 20 is constructed of a framework of aluminum bars and brass tubing with aluminum pop rivets and has a heavy fabric ribbon a strong, durable louver attachment results. The louver attachment requires no painting and has a good appearance.

The round, smooth surfaces of the rods 28 provide a smooth non-chafing contact for the ribbon and permit the ribbon to slide smoothly over the bar during collapsing and erection of the louver attachment.

I claim:

1. A collapsible and portable louver attachment for lights comprising:

a. a first elongated member having a first and second end and having a plurality of openings along its length;

b. a second elongated member having a first and second end and having a plurality of openings along its length;

c. means for pivotally connecting the elongated members at a distance from each other and maintaining them in a parallel relationship to form a framework;

d. a ribbon attached to the framework and woven between the elongated members passing through the openings in the elongated members so that louvers are formed which limit the amount of light cast in a direction normal to the louvers when the louvers are placed in front of a light source and permit the framework to be collapsed for transportation and storage.

2. A collapsible and portable louver attachment for lights, as claimed in claim 1, wherein the pivotal connecting means comprises a first elongated connecting link between the respective first ends of the elongated members and a second elongated connecting link between the respective second ends of the elongated members.

3. A collapsible and portable louver attachment for lights, as claimed in claim 1, wherein the elongated members each respectively comprise a pair of parallel bars and a multiplicity of parallel rods connected between the pair of parallel bars to form a ladder-like structure with the ribbon passing through the opening between rungs of the ladder which rungs are formed by the rods.

4. A collapsible and portable louver attachment for lights, as claimed in claim 3, wherein the rods have a round transverse cross-section to provide a smooth surface contact for the ribbon.

5. A collapsible and portable louver attachment for lights, as claimed in claim 3, wherein the rods on the first and second elongated member are laterally spaced so that the portions of the ribbon between the members are substantially parallel and substantially equally spaced.

6. A collapsible and portable louver attachment for lights, as claimed in claim 1, wherein the ribbon is secured to the elongated members only at the ribbon ends.

7. A collapsible and portable louver for lights comprising:

a. a first pair of parallel bars;

b. a multiplicity of parallel rods having a round transverse cross-section connected between the first pair of parallel bars to form a first ladder-like structure having a first and second end;

c. a second pair of parallel bars;

d. a multiplicity of parallel rods having a round transverse cross-section connected between the second pair of parallel bars to form a second ladder-like structure having a first and second end;

e. a first elongated connecting link pivotally connected between the respective first ends of the ladder-like structures;

f. a second elongated connecting link pivotally connected to the second ends of the ladder-like structures which link is parallel to the first link and maintains the ladder-like structures in a parallel relationship so that a collapsible framework having the shape of a parallelogram is formed, and g. a ribbon having a width substantially the length of the parallel rods attached to the framework at either end which is woven between the rods on the ladder-like structures to form parallel louvers which limit the light cast in a direction normal to the louvers when the louver assembly is placed in front of a light source.

* * * * *